United States Patent [19]

Brumlik

[11] 4,048,371

[45] Sept. 13, 1977

[54] FASCES FIBERS

[75] Inventor: George Brumlik, Montclair, N.J.

[73] Assignee: Ingrip Fasteners, Inc., Montclair, N.J.

[21] Appl. No.: 515,793

[22] Filed: Oct. 17, 1974

[51] Int. Cl.[2] ..... B32B 27/00; D02G 3/00

[52] U.S. Cl. ..... 428/375; 428/364; 428/369; 428/370; 428/378; 428/393; 428/394; 428/395; 428/397; 428/399

[58] Field of Search ..... 161/172, 173, 175, 176, 161/177, 148, 180; 428/369, 370, 371, 375, 378, 364, 374, 397, 399, 400, 393, 394, 395

[56] References Cited

U.S. PATENT DOCUMENTS

| | | | |
|---|---|---|---|
| 3,030,248 | 4/1962 | Runton | 161/176 X |
| 3,393,120 | 7/1968 | Touey et al. | 161/173 |
| 3,402,096 | 9/1968 | Blanchette | 161/173 |
| 3,681,189 | 8/1972 | Matsui et al. | 161/177 X |
| 3,775,228 | 11/1973 | Leary | 161/176 X |

*Primary Examiner*—Lorraine T. Kendell
*Attorney, Agent, or Firm*—Burgess, Dinklage & Sprung

[57] ABSTRACT

Fasces fibers consisting of fascicles of filaments bonded together at joints are disclosed. The joints may be focal or may be dispersed through the fiber fascicles in a statistical or predetermined pattern. The fascicles may be composed of the same type of fiber or from a mixture of different fibers. In one embodiment the fiber fascicle may contain coarser high tensile strength fiber(s), termed leader fiber(s), which is (are) accompanied and bonded to a group of slender fibers termed the satellite fibers. The latter fibers may provide properties that may be lacking in the mechanically strong leader fiber. These properties for example may include those of texture, softness, resiliency, bulk, insulation, moisture absorption, color and luster, antistatic properties and flame retardancy. The division of variables of fiber characteristics is a valuable feature of the present invention. Another feature of this invention is the ability to control the virtual volume which the composite faces fiber commands. The purpose of this invention is to effect savings in material. A further purpose of this invention is to provide fiber from which fabrics of exceptional lightness can be produced. Another purpose of this invention is to produce fibers for fabrics which can be fulled producing short or long nap and which are relatively lint-free. One of valuable properties of the composite fasces fiber resides in its ability to retain its integrity inspite of the severance of a portion of its constituent fibers.

2 Claims, 7 Drawing Figures

FASCES FIBERS

BACKGROUND

Conventional man-made fibers have evolved from single component filaments of essentially round cross-sections into fibers having cross-sectional shapes of various types. Some of the man-made fibers have more than one component. However, on progressing along the fiber axis of the conventional filament a lack of substantial structural, physical and chemical variation is encountered. This lack of the enumerated radial and axial variation greatly restricts the degrees of freedom in the above-mentioned properties of conventional fibers. The present invention overcomes the said limitations and restrictions. The control of variables (as they change from point to point) is accomplished in the fibers of the invention by joining accompanying fine filaments at points into an integral fiber structure.

DESCRIPTION

The term "fiber" is used herein to generically describe a composite filamental structure consisting of filaments travelling together which are bonded at repeating sites into a continuous whole.

Figure 1:
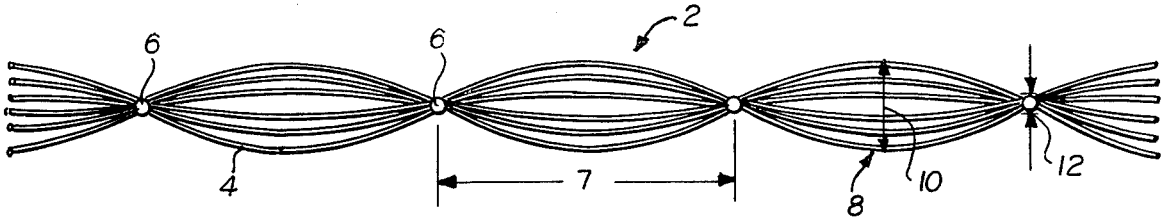
FIG. 1 is an elevational view of a section of an embodiment of a fasces fiber of the present invention composed of a fascicle of filaments held together at focused points placed at intervals along the fiber. The fascicle fans out between the knots and comes together at the knots.

Referring now to the drawing, the fasces fiber 2 of FIG. 1 is composed of constituent filaments 4 bonded together at joints 6. Between any two adjacent joints 6 is a bundle or streamer fibers 8. The filaments present in the bundle 8 may have unequal lengths, which makes the longer filaments (such as filament 4) fan out in the radical direction of the fiber and command a substantial virtual space. A partial measure of this virtual space is the maximum diameter 10 of the fiber 2. The whole bundle of fibers 8 may be straight, twisted or intertwined. The diameter 12 of the joint 6 reaches a minimum if the fiber components 4 of the fiber 2 are tightly packed and compressed.

The bonding of the component fibers at the focused or dispersed joints 6 can be accomplished by a variety of means. Among the said means is the fusion of the fiber components by the application of heat, pressure, focused electromagnetic radiant energy produced by conventional sources or by a laser, or by the application of adhesive. The adhesives include polyurethanes, alkylcyanoacrylates and acrylic and rubber based adhesives, solvent based adhesives, hot met adhesive compositions, adhesives and pressure sensitive adhesives that are polymerized by the action of ultraviolet radiation and the like. Similar considerations of the joint size and properties, as described above, apply to all joints 6 present (and described in conjunction with) in FIGS. 1 to 4*b*. The joint 6 may also be formed by binding a streamer or group of fibers by an enveloping ring loop, tubular element, fiber or film. The length and the diameters of the free fiber bundles 8 between joints 6 can be made of any desirable length, and the individual lengths can be varied in any sequence in a predetermined pattern. The said predetermined spacing and diameter of the joints along the fiber axis corresponds to a physical memory effect of the fiber and establishes important variables not available in conventional fibers. The linear members or filaments 4 can be of any workable cross-section and can vary both axially and radially in properties.

Fibers of my co-pending U.S. Pat. application, Ser. No. 401,084, filed Sept. 26, 1973, now U.S. Pat. No. 3,953,647, can be used. The composition of the said filaments may be identical or may differ. The combinations of the structure and chemical composition provides the feature of the separation of variables within the composite fiber. An additional advantage of the fasces fiber is its ability to retain integrity on the severance of a portion of its filament constituents. The ability to maintain integrity incorporated into fabric structure introduces resistance to lint formation and provides a mechanism for limiting defibrilation. Defibrilation of the filament streamer is arrested at the joints 6.

Figure 2A:
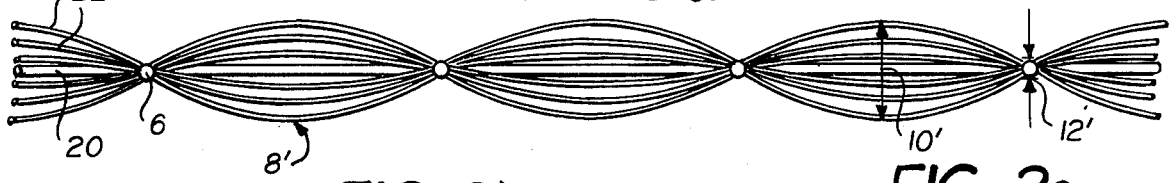
FIG. 2 is an elevational view of another embodiment of a section of a fasces fiber having a coarse tensile leader filament at (or parallel to) the axis of fasces which is accompanied by a group of slender satellite filaments. The slender satellite filaments are longer than the coarse leader fiber and fan out substantially between the knots which join the fascicle together sequentially along the progressing directions of the fasces fibers.
FIG. 2*b* is an elevational view of a fasces fiber in which the composite filaments are bonded at points common to only a few component filament fibers of the whole fascicle.
FIG. 2*c* is a cross-sectional view corresponding to FIG. 2*b* showing the disposition of the bonding points or sites in the fascicle fiber. The FIGS. 2*c* and 2*b* illustrate ways in which a leader and satellite filaments may be included in this version of the fasces fibers.
Figure 2B:
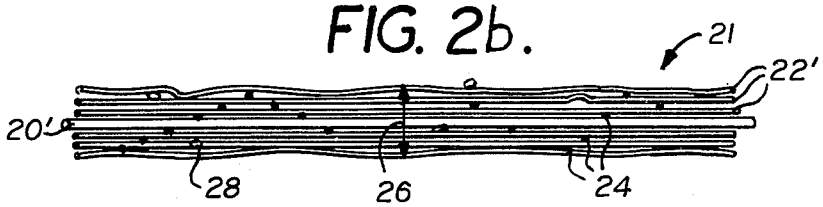
Figure 2C:
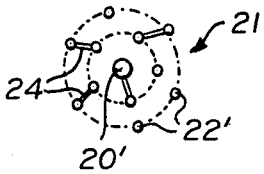

In FIG. 2*a* and 2*c*, the filament 22, termed "the satellite filament," corresponds to filament 4 of FIG. 1, and has been given a separate numeral to differentiate it from the coarser filament 20, termed the leader filament.

In the present invention one or more leader filaments 20 can be employed in the fasces fibers as elements having high tensile and/or flexural strength as well as toughness. The filaments 22, termed the satellite filaments are endowed with other fiber properties such as moisture absorbency, softness, color, luster and sheen, and the command of a large virtual space resulting in high bulk. Since the satellite fibers determine the visual and tactual characteristics of the fiber, a much larger diameter and thus higher tensile strength and stiffness can be built into the leader fiber than is possible in a conventional fibers. The satellite filaments also protect the leader filaments from damage due to impact and sheer forces. This feature is carried over to the characteristics of resultant fabrics and constitutes an additional advantage.

While in FIGS. 1, 2*a*, 3 and 4 the filaments of the fasces are essentially bonded together all at once at predetermined joints 6 spaced along the length of the fasces fiber, the fiber 21 of FIG. 2*b* is of a different structure. In particular, only a portion of the filaments 22' is bonded at single joints 24 the number of filaments 22' bonded together at joints 24 is at least two and may be a multiplicity thereof. It is within the scope of this invention to combine the structures of fasces fibers represented by the FIGS. 1, 2*a* to *c*, 3 and 4. The filament components of the fiber 21 may be uniform or may be any desired combination. For example, one or more leader fibers 20' may be incorporated within a structure of the satellite fibers 22'. The joints 24 may be formed in similar manner as described above in connection with joints 6 of FIGS. 1 and 2*a*. The joints 24 can be spaced in a three dimensional spatial pattern in any predetermined manner. The control over the joint pattern is an important and unique element of control over fiber properties, which can be made to vary both in the axial and radial direction of the fasces fiber.

By the means of the control over the spatial characteristics of the joint pattern, the outer shape of the envelope 28 can be given any desired shape. The envelope can, for example, have successive ridges, can have one or a plurality of helical patterns appearing as crests and troughs on its surface. The envelope can have desired indentations and protrusions. The joint pattern affects in addition the internal structure and internal properties of the fasces fiber. FIG. 2*c* is a cross-sectional representation corresponding to one embodiment of FIG. 2*b*, one embodiment of the radical distribution of the joints 24.

Figure 3:
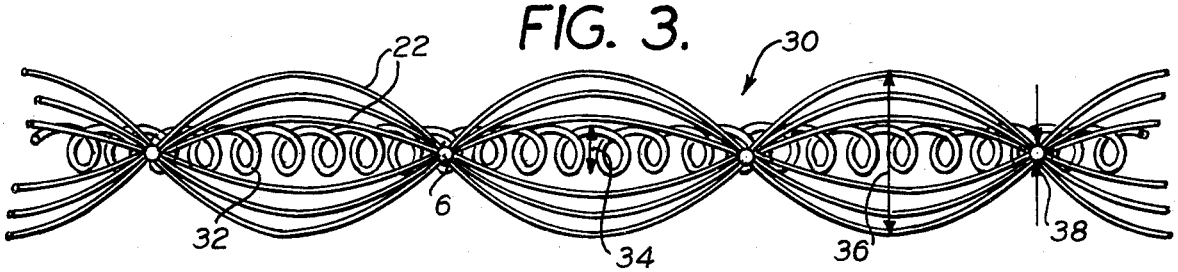
FIG. 3 is an elevational view of fasces fiber similar to the one of FIG. 2*a* having the leader fiber coiled.
Figure 4A:
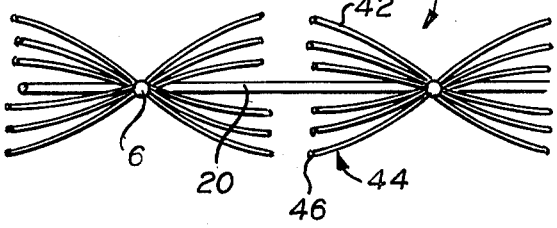
FIGS. 4*a* and *b* are an elevational view representing a stretched fasces fiber which has been axially stretched retaining the integrity of the leader fiber and having the ruptured satellite fibers attached in tufts to the leader filament by means of the focused modules. The structured fiber represented in FIG. 4*a* resulted from stretching the fasces fiber of the embodiment of FIG. 2*a*, and the structural fiber represented by FIG. 4*b* resulted from stretching the fasces fiber represented in FIG. 3.
Figure 4B:
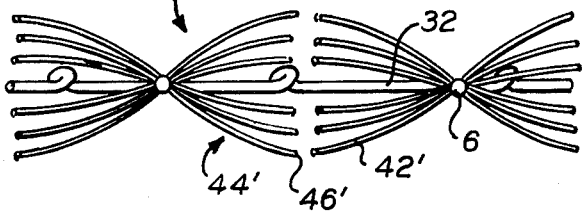

The fasces fiber of FIG. 2*a* can take the form 30 in FIG. 3 by replacing a linear leader element 20 by a leader element 32 having curls or crimp in the radical width 34. When the fasces fibers of FIG. 2*a* and FIG. 3 are stretched, the weaker satellite filaments 22 are severed separating into clusters 44 and 44' consisting of filaments 46 and 46' having one free end and attached at common joints 6. The said clusters are shown in FIGS. 4*a* and 4*b* respectively. The structures 40 and 40' of FIG. 4*a* portray a filament having fiber clusters or tufts. The said tufts 44 and 44' can be formed at various stages by a variety of methods. For example, the satellite fibers can be severed in the fasces fiber proper in the yarn of which the said fiber is a component, or in the fabric containing the fasces fiber.

The ability of the fiber to retain integrity on severance of a portion of its filament constituents makes it ideal as a fiber than can be filled for greater esthetics and for manufacture of specialty fabrics such as artificial furs. The said fiber integrity thus makes possible to change the fiber structure by a secondary operation after the described fiber has been incorporated into a fabric. The satellite filament components are shown in the drawings as smooth, but can be curled, crimped, wavy, coiled and may have any desired structure.

The satellite as well as the leader filament components of the fasces fibers can be continuous or discontinuous. The diameter of the component filaments can be the same or can differ. The component filaments can be synthetic filaments or natural fibers of plant or animal origin and can be used in any desired combination.

The component filaments of which the fasces fiber is formed can be of the following chemical composition: polyester, polyamides, polyimides, rayon, polyurethane based polymers, cellulosic materials, cellulose acetate and triacetate, acrylics, polyolefins, polyvinyl polymers, protein based polymers, glass, refractories, metal and metallized fibers. Natural fibers, cotton, flax, ramie, wool and other animal hair can be utilized as components of the described composite fibers. The fasces fibers may be utilized entirely alone or in any desired blend with other fibers in the manufacture of nonwoven or woven fabric, knitted goods, spun yarn and other textile products. The said fibers have application in areas outside of the textile field.

What is claimed is:

1. Composite textile filament comprising an assembly of at least two synthetic or natural textile filaments selected from a group consisting of polyester, polyamides, polyimides, rayon, urethane based polymers, cullulose acetate, cellulose triacetate, acrylic polymers, polyolefins, vinyl polymers, protein based polymers, cotton, flax, ramie, wool and animal hair extending together in the longitudinal direction and held together at joints connecting individual fibers, said joints being spaced in a three-dimensional spatial pattern, said joint pattern varying both in the axial and radial directions of the individual fibers.

2. A composite filament according to claim 1 comprising at least one coarse inner filament joined to a plurality of fine outer filaments surrounding said coarse filament.

* * * * *

UNITED STATES PATENT AND TRADEMARK OFFICE

CERTIFICATE OF CORRECTION

PATENT NO. : 4048371

DATED : September 13, 1977

INVENTOR(S) : GEORGE C. BRUMLIK

It is certified that error appears in the above-identified patent and that said Letters Patent are hereby corrected as shown below:

[75] "George Brumlik" should read -- George C. Brumlik --.

Column 2, line 37, "3,953,647" should read -- 3,922,455 --.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*